US006508138B1

(12) United States Patent
Focke et al.

(10) Patent No.: US 6,508,138 B1
(45) Date of Patent: Jan. 21, 2003

(54) METHOD OF, AND DEVICE FOR, CHECKING CIGARETTES

(75) Inventors: Heinz Focke, Verden (DE); Kurt Meyer, Kirchlinteln-Neddenaverbergen (DE); Dietrich Below, Bülstedt (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/559,992

(22) Filed: Apr. 27, 2000

(30) Foreign Application Priority Data

Apr. 28, 1999 (DE) ..... 199 19 207

(51) Int. Cl.[7] ..... B65G 33/00
(52) U.S. Cl. ..... 73/865.8
(58) Field of Search ..... 73/865.8; 324/207.24, 324/207.2, 207.18, 207.22; 131/908–910; 209/535

(56) References Cited

U.S. PATENT DOCUMENTS

| | | | | |
|---|---|---|---|---|
| 4,937,523 A | * | 6/1990 | Duverger et al. | 324/207.18 |
| 5,214,376 A | * | 5/1993 | Sikora | |
| 5,742,161 A | * | 4/1998 | Karte | |
| 5,789,918 A | * | 8/1998 | Imai et al. | 324/207.18 |
| 5,793,201 A | * | 8/1998 | Nelle et al. | 324/207.2 |
| 5,801,530 A | * | 9/1998 | Crosby et al. | |

FOREIGN PATENT DOCUMENTS

| | | |
|---|---|---|
| DE | 499028 | 5/1930 |
| DE | 2311084 | 9/1974 |
| DE | 37 33 955 | 4/1988 |
| DE | 196 22 561 | 12/1996 |
| FR | 1122720 | 9/1956 |
| FR | 1271375 | 7/1961 |
| GB | 2044457 | 10/1980 |
| GB | 2 196 311 | 4/1988 |
| GB | 2198624 | 6/1988 |

* cited by examiner

*Primary Examiner*—Robert Raevis
(74) *Attorney, Agent, or Firm*—Sughrue Mion, PLLC

(57) ABSTRACT

The invention relates to a method of, and to a device for, checking cigarettes (12) during the production or packaging of the cigarettes (12), a push rod (35) being displaced axially in the direction of a cigarette end, with the result that, in the event of the incorrect formation or absence of a cigarette (12), the push rod (35) assumes a position other than an ideal position. The invention is based on the problem of improving the operation of checking cigarettes and of configuring this operation such that it is less susceptible to malfunctioning.

This problem is solved by a method according to the invention in that an electric, magnetic or electromagnetic field assigned to a sensor (32, 53) is influenced in dependence on the position of the push rod (35), a signal which corresponds to the push-rod position being generated as a result of said field being influenced. The invention also relates to a device for implementing said method.

8 Claims, 4 Drawing Sheets

IV
IV
18
19
20
29
30
32
33
34
35
36
37
38
39
40
41
42
43
44
45
46
47
48
49
50
51
54

METHOD OF, AND DEVICE FOR, CHECKING CIGARETTES

BACKGROUND OF THE INVENTION

The invention relates to a method of checking cigarettes during the production or packaging of these cigarettes, a push rod being displaced axially in the direction of a cigarette end, with the result that, in the event of the incorrect formation or absence of a cigarette, the push rod assumes a position other than an ideal position. The invention also relates to a device for checking cigarettes for cigarette-packaging and/or cigarette-production machines, having at least one axially displaceably mounted push rod which has a head for penetrating into a cigarette end.

Methods and devices are known for checking cigarette ends using push rods, which are arranged in three layers and correspond to the geometry of a cigarette formation, said push rods being advanced up to a cigarette formation in order to check the cigarette ends. In the event of the correct formation of the cigarettes, in this checking operation, all the push rods are pushed into a rear position. However, if a cigarette is absent or if a cigarette is only loosely filled, the push rod remains in its starting position or is only pushed in to a slight extent. This operation of pushing in the push rods is usually checked by means of a light barrier provided for each layer. It is thus possible to infer from the pushing-in depth whether cigarettes are absent or defective. This checking method has the disadvantage that the light-barrier components become dirty over time. This may result in operational malfunctioning and thus in production being interrupted. Frequent maintenance of these installations is thus necessary.

SUMMARY OF THE INVENTION

The invention is thus based on the problem of improving the operation of checking cigarettes and of configuring this operation, in particular, such that it is less susceptible to malfunctioning.

In order to solve this problem, the method according to the invention is characterized in that an electric, magnetic or electromagnetic field assigned to a sensor is influenced in dependence on the position of the push rod, a signal which corresponds to the push-rod position being generated as a result of said field being influenced. The problem is also solved by a checking device according to the invention, which is characterized in that the push rod has a region for influencing an electric, magnetic or electromagnetic field assigned to a sensor, the sensor being designed such that it generates a signal which corresponds to the push-rod position as a result of said field being influenced. An advantage of the invention is that the checking method according to the invention or the checking device according to the invention is no longer susceptible to dust, since it is not based on an optical principle.

The position of the push rod is preferably determined by way of a depth to which a ferromagnetic and/or ferrimagnetic region of the push rod penetrates into the interior of a sensor-forming, in particular annular, coil. In this case, the coil is connected electrically to a measuring arrangement which emits a signal in dependence on the depth, representing the push-rod position, to which the ferromagnetic and/or ferrimagnetic region penetrates into the coil.

It is also preferred for the position of the push rod to be determined by way of a sensor-forming Hall element being magnetized by a magnetic field generated by a magnetic region of the push rod, it being the case that the Hall element is subjected to an electric voltage on two opposite sides and the signal is generated in dependence on the magnetic field, which magnetizes the Hall element and represents the push-rod position. Here too, the Hall element is preferably connected to an electric measuring arrangement which emits a signal in dependence on the magnetic field, which magnetizes the Hall element and represents the push-rod position.

The advantage of these preferred solutions is that they are small enough in order to be able to sense each cigarette of a relatively large cigarette formation at the same time. By virtue of the invention, it is then no longer necessary for cigarettes to be checked at different locations or times. This is because the devices according to the invention may be small enough for the necessary measuring arrangements, namely Hall elements or coils, not to be larger than the thickness of a cigarette. In particular, the coils thus have an external diameter which is smaller than a cigarette diameter.

It is preferable, during a checking operation, for all the cigarettes of a cigarette formation fed to a cigarette pack to be checked at the same time, the individual push-rod positions being evaluated individually, with the result that systematic faults can be detected. The latter include, in particular, such faults as occur in the case of adjacent cigarettes or cigarette positions which are located in different layers one above the other. It is thus possible to detect, for example, a defective cigarette shaft. In the event of such a fault, finally, an alarm or control signal is generated in order to reduce the rotational speed of a packaging and/or production machine, or in order to stop the same.

The push rods are preferably interrogated individually. For this purpose, each push rod is assigned an element which can be interrogated individually, namely a Hall element or an, in particular, annular coil. The signals emitted by these elements are evaluated by means of an evaluation unit. This evaluation unit is small enough to be accommodated in the housing of the checking device, with the result that it is advantageously possible to dispense with high-outlay wiring of all the individual elements to a central machine-control means.

BRIEF DESCRIPTION OF THE DRAWINGS

Further details of the invention can be gathered from the subclaims and with reference to the exemplary embodiments illustrated in the drawing, in which:

DETAILED DESCRIPTION OF THE INVENTION

Figure 1:
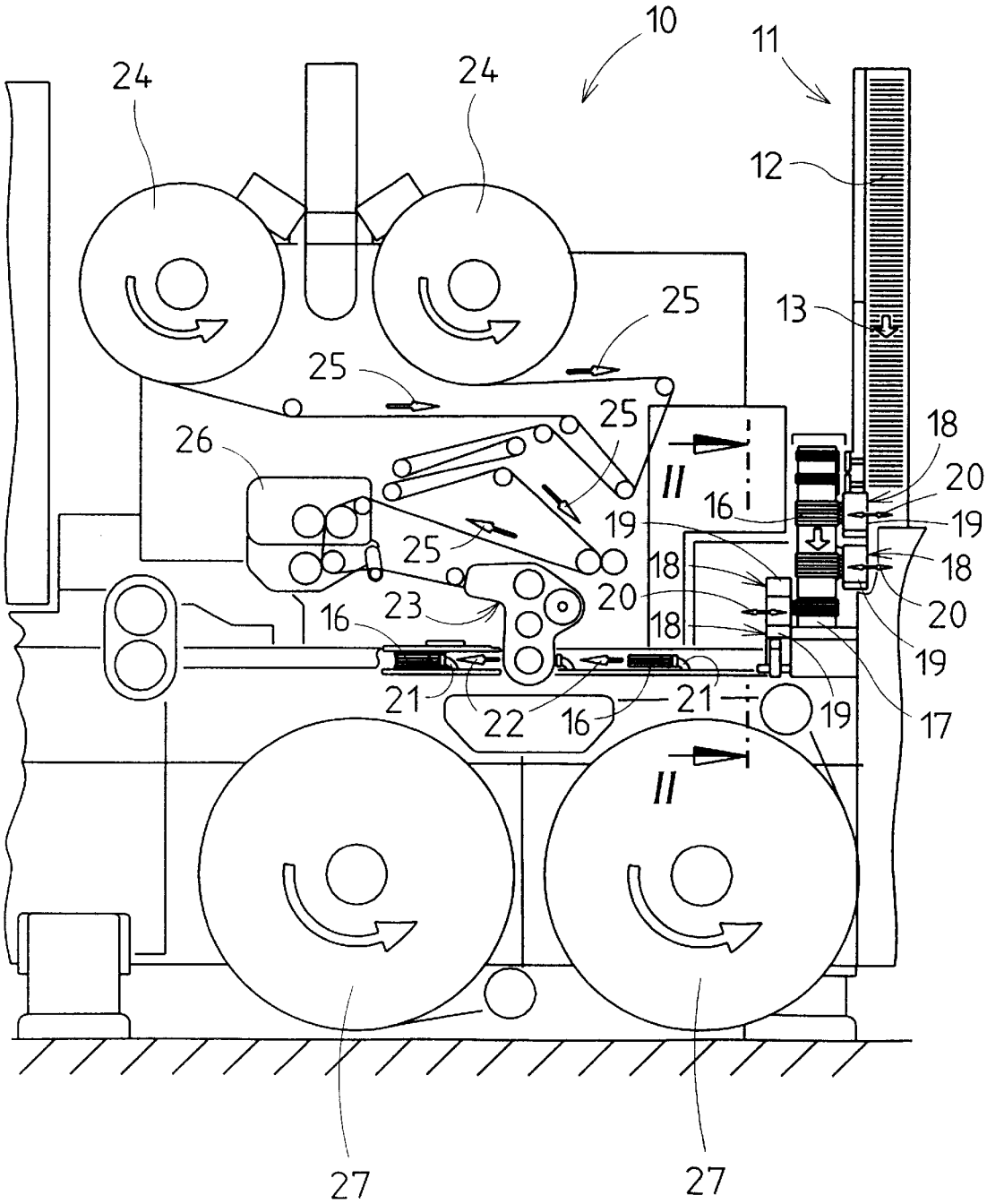
FIG. 1 shows part of a cigarette-packaging machine with checking devices arranged on both sides of the cigarettes which are to be checked.

FIG. 1 shows a cigarette-packaging machine 10 with a cigarette magazine 11, in which cigarettes 12 are located and which move downwards, as the packaging process is in operation, in the direction of the arrow 13 illustrated in FIG.

Figure 2:
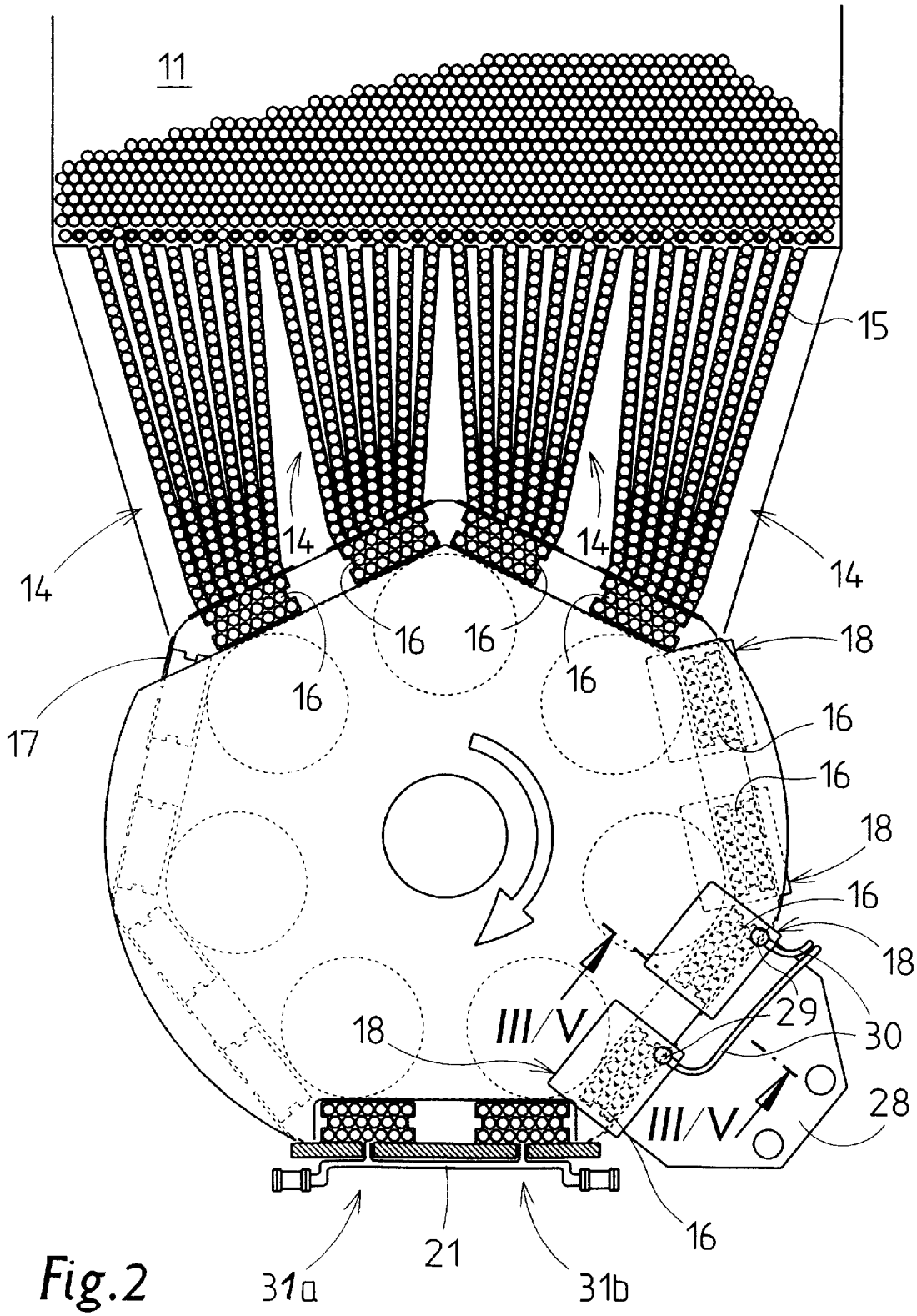
FIG. 2 shows a section of the packaging machine from FIG. 1 along line II—II.

2. The magazine 11 opens out into a plurality of, namely 4, shaft groups 14, which are illustrated in FIG. 2 and each comprise a plurality of, namely seven, shafts 15.

Formed at the bottom end of the shafts 15 is in each case one cigarette formation 16, that is to say a total of four cigarette formations 16. Each cigarette formation 16 comprises three layers, the outer layers each comprising seven cigarettes and the inner layer comprising six cigarettes. However, other formations with a different number of layers and/or cigarettes per layer are also possible. A rotating cigarette turret 17 transports the cigarette formations 16 for further packaging. During the rotation of the formations 16 in the turret 17, the cigarettes are at rest relative to one another. The cigarettes turret is thus preferable for carrying out a cigarette-checking operation, in particular for checking that cigarette formations are complete.

As can be gathered from FIG. 1, four checking devices 18 are located on the right and left of the cigarette turret 17. These checking devices 18 are arranged on both sides of the cigarette turret 17 such that two devices serve for checking the filter-side cigarette ends and two further devices 18 serve for checking the tobacco-side cigarette ends. The checking devices 18 are accommodated in a housing 19 which can be displaced in a longitudinal direction of the cigarettes. The respective housings 19 can be displaced in the direction of the double arrow 20 illustrated in FIGS. 1, 3 and 5, to be precise by means of an adjustment arrangement (not illustrated). The adjustment arrangement displaces a checking device 18 in the direction of a cigarette formation 16 in order to carry out a checking operation, which is described in more detail hereinbelow.

Following checking of the cigarettes as the formations 16 run through the cigarette turret 17, a conveyor 21 guides the formations 16 in the direction of the arrows 22, to be precise in the direction of a subassembly 23 for winding the formations in tin foil. Tin-foil reels 24 store the tin foil in a state in which it is wound up in web form and discharge it in the direction of the arrows 25, namely in the direction of the subassembly 23. On the way to the subassembly 23, the tin-foil web passes a stamping device 26. The subassembly 23 also serves for cutting the tin-foil web into blanks, which are wound around cigarette formations. Collar reels 27 store material webs which are wound up in web form and are intended for collars which are to be cut to size and are positioned on the cigarette formations 16 wrapped in tin foil.

FIG. 2 shows a section along line II—II according to FIG. 1 through the packaging machine 10, for the detailed illustration of the arrangement of the checking devices 18. Two checking devices 18 illustrated by solid lines are located on the front side of the cigarette turret 17 and are mounted on a common carrier 28. Two further checking devices 18 are located on the rear side of the cigarette turret 17 and are illustrated by dashed lines. These rear-side checking devices 18 are also mounted on a common carrier (not illustrated). The checking devices 18 are connected to a machine-control means (not illustrated) in each case via connections 29 and connection cables 30. Once they have passed the checking devices 18, the cigarette formations 16 pass, by way of the cigarette turret 17, into a discharge position, in which they are carried along on two parallel conveying sections 31*a*, 31*b* by a conveyor 21.

Figures 3, 4:
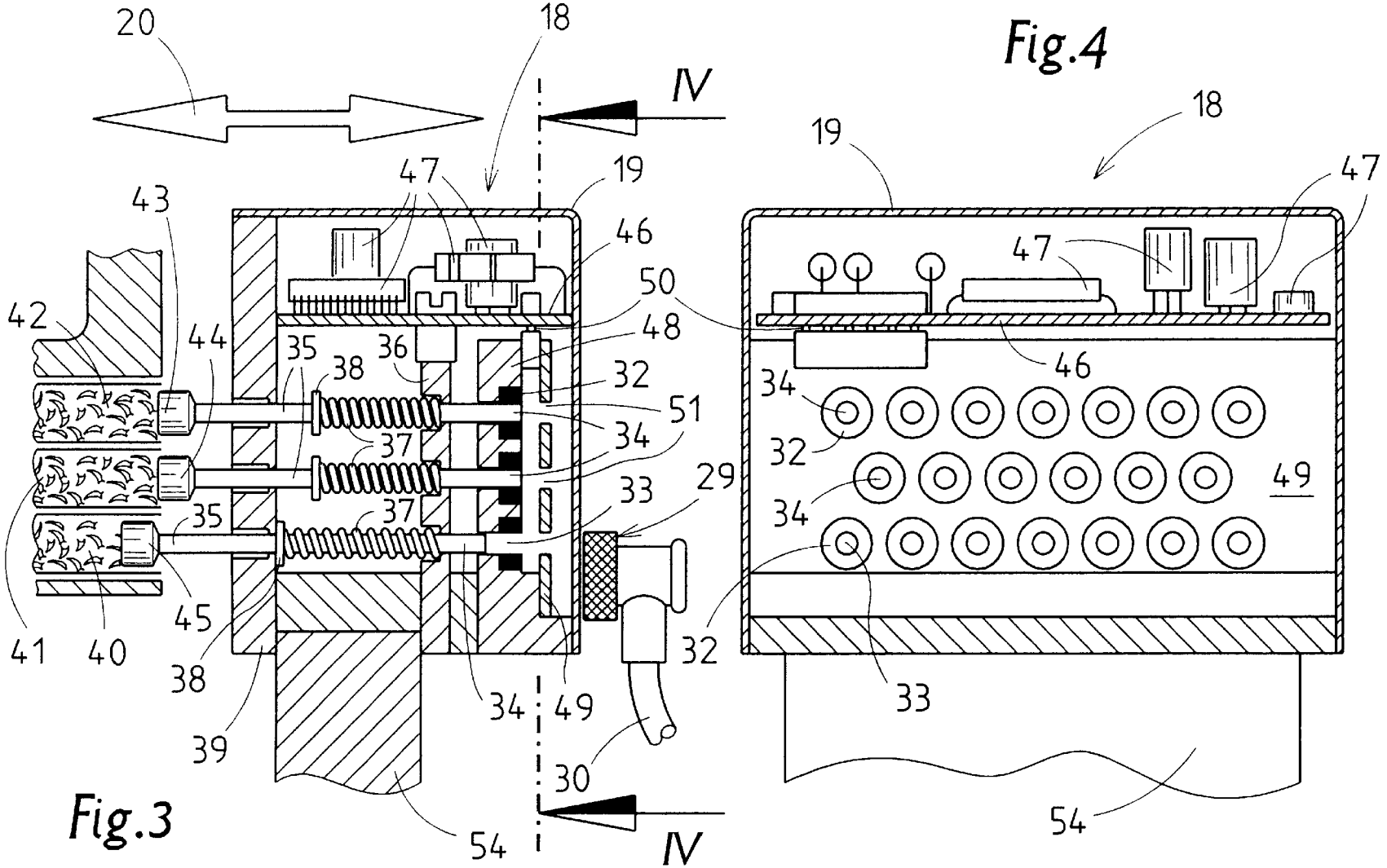
FIG. 3 shows a checking device along section line III/V—III/V according to FIG. 2.
FIG. 4 shows a checking device along section line IV—IV according to FIG. 3.

FIGS. 3 and 4 show a checking device with annular coils 32, which have an interior cavity 33. A ferromagnetic or ferrimagnetic region 34 of a push rod 35 (in the manner of a coil core) can pass into said cavity 33. This means that the push rod is produced either just partially or else completely from ferromagnetic or ferrimagnetic material. The push rod 35 is mounted in the housing 19 such that it can be displaced axially counter to a spring force. In this case, a spring 37, which is supported on an inner housing wall 36, causes the push rod 35 to be pushed out of the housing, to be precise until a stop 38, against which the spring 37 pushes, reaches an outer housing wall 39. In order to carry out a checking operation, the housing 19 together with the push rod 35 and coils 32, is displaced in the direction of cigarettes 40, 41, 42 which are to be checked.

In the presence of a correctly filled cigarette 41, 42, a head 43, 44 of a push rod 35 comes to rest on the cigarette end, with the result that the end with the ferromagnetic/ferrimagnetic region 34, said end being located opposite this push-rod head 44, 45, penetrates into the cavity 33 of the coil 32. If, however, a cigarette 40 is of defective formation or if a cigarette is absent from this position, the push rod remains in its starting position, with the result that the ferromagnetic/ferrimagnetic region 34 of the push rod 35 does not pass into the cavity 33 of the coil 32. It is thus only in the presence of a correctly filled cigarette that the push rod 35 reaches a first push-rod position, as is shown in FIG. 3 for the two top push rods 35. In contrast, the bottom push rod 35 is located in a second position, in which the ferromagnetic/ferrimagnetic region 34 of this push rod 35 does not penetrate into the coil interior.

The second position is generally characterized in that the ferromagnetic/ferrimagnetic region does not fully reach the coil interior, for example also when the ferromagnetic/ferrimagnetic region 34 only partially fills the coil interior or the cavity 33.

The penetration of the ferromagnetic/ferrimagnetic region 34 of the push rod 35 into the cavity 33 of the coil 32 changes the inductance of the coil 32. This change can be measured. According to a first variant, for this purpose, the coil is subjected to alternating current or alternating voltage. The electrical behavior of the coil changes as a result. For example, it is possible to determine the changed damping behavior of an oscillator which is formed by means of the Coil—and is likewise subjected to alternating current or alternating voltage. For example, the change in impedance is also obtained by determining a different resonant frequency of an oscillating circuit formed from said coil and a capacitor or if the oscillation of the oscillating circuit breaks off.

In a further variant, the coil is subjected to direct voltage or direct current. The action of pushing in the ferromagnetic/ferrimagnetic region then likewise results in a change in inductance. With a constant current through the coil, the energy content of the coil thus changes. Conversely, with a constant energy content of the coil, the current through the coil changes with a change in the inductance. Such changes may be measured, and it is possible to draw therefrom information about the push-rod movement and thus the depth by which the push rod penetrates into the cigarette end.

In this arrangement, the push rod 35 is mounted such that the ferromagnetic and/or ferrimagnetic region 34 of the push rod 35 can penetrate concentrically into the interior of the coil 32. This allows such a device for interrogating each individual push rod 35 to be of very small construction. It is easily possible in this way for the sensor which has the coils 32 to be configured such that it is smaller than a cigarette diameter of approximately 5.3 to 7.9 mm. The coils 32 are likewise arranged at a distance corresponding to this diameter. The coils 32 thus have a smaller external diameter than the cigarette diameter, to be precise preferably not more than 5 mm. The push rods 35 then preferably have a maximum external diameter of approximately 2 mm.

The construction described has the advantage that all the coils and/or sensors can be accommodated within the housing 19. The space-serving construction additionally makes it possible to accommodate within the housing 19 an evaluation arrangement which may have a microprocessor and also has an evaluation board 46 in addition to electrical and electronic components 47. It is thus possible for the evaluation arrangement to be accommodated in the vicinity of the actual sensors and/or coils, with the result that it is possible to dispense with high-outlay wiring of all the sensors to a remote evaluation unit, for example the machine-control means. The connection to the machine-control means 29 therefore need only have a small number of lines, rather than a number of lines which corresponds to the number of sensors. As a result, the packaging machine, as a whole, is less susceptible to malfunctioning and, furthermore, can also be produced more cost-effectively.

The coils 32 are arranged in a carrier element 48 which is connected to the housing 19 and has bores for receiving the annular coils 32 and bores which are arranged concentrically with the above and are intended for receiving the push rods 35. The carrier element 48 also provides the mechanical stability of the arrangement of the coils 32. The electrical connection of the coils 32 to the evaluation electronics located on the evaluation board 46 takes place by means of traces arranged on a printed circuit board 49. The printed circuit board 49 is connected to the evaluation board 46 via a plug-in connection 50. The printed circuit board 49 has bores 51 which are located opposite the push rods 35 and avoid damage to the printed circuit board 49 if the push rods 35 are pushed too far into the interior of the housing 19.

Figures 5, 6:
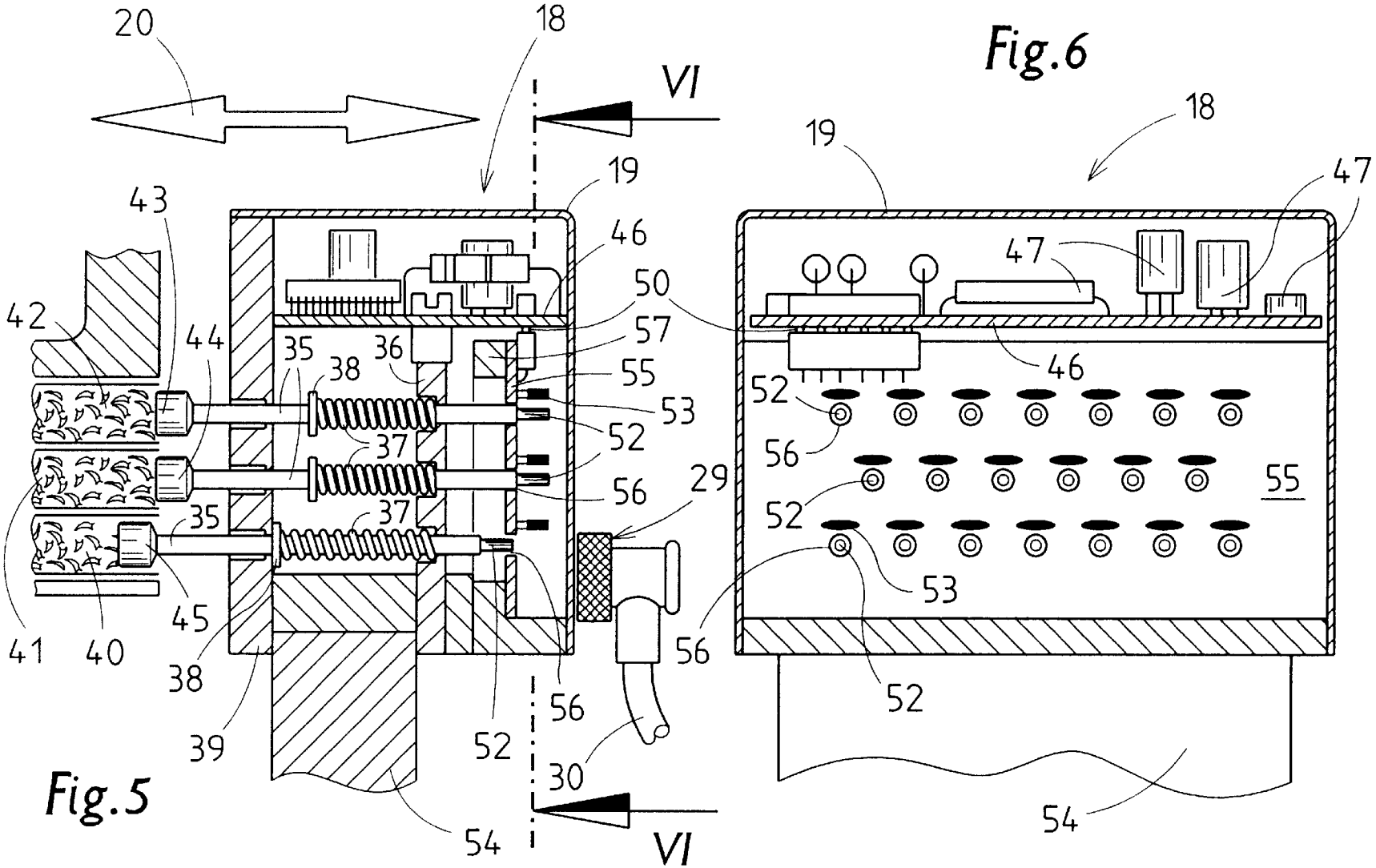
FIG. 5 shows a checking device along section line III/V—III/V according to FIG. 2.
FIG. 6 shows a checking device along section line VI—VI according to FIG. 5.

A further checking device 18 is illustrated in FIGS. 5 and 6. This checking device 18 differs from the checking device according to FIGS. 3 and 4 in that, instead of ferromagnetic/ferrimagnetic regions on the push rods, a magnetic region 52 is provided on each push rod. This magnetic region 52 is a bar magnet which generates a constant magnetic field. However, coils which generate a magnetic field are also possible. By virtue of a push rod being displaced, this magnetic field can then magnetize a Hall element 53 in a first position, namely one which applies to the two top push rods 35. In a second position, however, the magnetic field magnetizes the Hall element 53 merely to a lesser extent or not at all. This second position corresponds to the position illustrated in FIG. 5 for the bottom push rod 35. The Hall element 53 is connected to an electric reference voltage or power source on two mutually opposite sides. As a result of the magnetic lines of force passing vertically through the Hall element, charge carriers are deflected perpendicularly to the reference-source-induced movement direction thereof. This produces a potential difference, referred to as Hall voltage, on two sides of the Hall element which are offset in relation to the connections of the reference source. This Hall voltage is measured by means of an electric measuring arrangement. This voltage generates a signal in dependence on the magnetic field, which magnetizes the Hall element 53 and represents the push-rod position.

The measuring arrangement for determining the push-rod position with Hall element 53 and magnetic push-rod region 52 also allows the device to have a small formation, with the result that it is also possible in this case for the necessary electronics to be accommodated within the housing 19. There is thus also provided in this checking device an evaluation board 46 for accommodating electrical and/or electronic components 47, in particular a microprocessor for evaluating the sensor signals or signals of the Hall elements 53, within the housing 19. The evaluation board 46 is connected to a printed circuit board 55 via a plug-in connection 50. This printed circuit board 55 has the Hall elements 53, which are arranged in the region of bores 56. These bores 56 are arranged opposite the push rods 35 and serve for guiding the magnetic regions 52 of the push rods 35. The electrical connection of the Hall elements 53 to the evaluation board 46 takes place via traces arranged on the printed circuit board 55 and via the plug-in connection 50. A carrier element 57 connected to the housing 19 serves for securing said printed circuit board 55.

The two checking devices 18 according to FIGS. 3 and 4 and according to FIGS. 5 and 6 are connected, via a connecting element 55, to an adjustment arrangement for advancing the checking device 18, together with push rod 35, up to the cigarettes in order for a checking operation to be carried out. Said adjustment arrangement can be actuated mechanically, electrically, pneumatically and/or hydraulically.

Either the evaluation unit already provided on each checking device or the machine-control means determines data on possible malfunctioning by way of the signals supplied by the coils or Hall elements. Since preferably an entire cigarette formation is sensed in each checking operation, it is possible, for example, for three adjacent coils or Hall elements which are located one above the other and each display a fault to indicate a blocked cigarette shaft. By way of the signals generated by the evaluation unit and/or machine-control means, it is possible for an alarm or fault signal to be generated or else also for a control signal to be generated in order to stop the machine or to change certain machine parameters, for example the rotational speed of the machine. Furthermore, in order to eject a defective cigarette formation, it is possible to emit a control signal which causes an ejector to separate the defective cigarette formation out of the packaging process.

Overall, the reduced construction of the measuring arrangements sensing the individual push rods provides a compact checking device which, on account of the absence of optical components, is less susceptible to malfunctioning on account of dust. This means that the devices and methods according to the invention can configure the operation of checking cigarette ends in a considerably more reliable and meaningful manner. The invention also allows evaluation via the production data acquisition, with the result that it is possible to ascertain the filling of an individual cigarette position. This makes it possible to detect any possible unreliability of individual cigarette shafts in the cigarette magazine. The cigarette checking and/or head monitoring is advantageously already carried out using a microprocessor accommodated in the checking device, with the result that it is possible for the sensor signals to be evaluated already in the checking device.

The devices explained also have the advantage that cleaning of the mechanical components is possible without the device as a whole and electronic components being dismantled or detached since it is possible to remove lateral covers (not illustrated) for cleaning, for example, using a compressed-air gun. Furthermore, the arrangement described has the advantage that a push rod 35 which is pushed in too far cannot damage the coils 32 or Hall element 53 and the associated printed circuit boards 49, 55, as may be the case, for example, in other arrangements with axially arranged initiators and/or proximity switches. The invention thus makes it possible to achieve a considerable improvement in cigarette checking as a whole.

What is claimed is:

1. A method of checking cigarettes (12) during production or packaging of the cigarettes (12) in a packaging and/or production machine (10), a push rod (35) being displaced axially in a direction of a cigarette end, with the result that, in event of incorrect formation or absence of one of the cigarettes, the push rod (35) assumes a position other than an ideal position, with an electric, magnetic or electromagnetic field assigned to a sensor (32, 53) being influenced as a function of the position of the push rod (35), with a signal which corresponds to the push-rod position being generated as a result of said field being influenced, and with the position of the push rod (35) being determined by a depth to which a ferromagnetic and/or ferrimagnetic region (34) of the push rod (35) penetrates into an interior of a sensor-forming coil (32), said method further comprising damping, as a function of said depth of penetration, an oscillating circuit formed by the coil (32).

2. The method according to claim 1, wherein the oscillating circuit is damped until the oscillation is broken off.

3. The method according to claim 1, wherein, during a checking operation, all cigarettes of a cigarette formation (16), which has a plurality of cigarettes (12), are checked essentially at the same time, wherein pushrod positions are evaluated individually in order to detect systematic faults occurring in adjacent cigarette positions, which are located in different layers, and indicating a disrupted cigarette shaft, and wherein an alarm or control signal is generated, in the event of a fault, in order to reduce a rotational speed of said packaging and/or production machine (10), or in order to stop said machine.

4. A device, for checking cigarettes in a cigarette-packaging and/or cigarette-production machine, having at least one axially displaceably mounted push rod (35) which has a head (43–45) for penetrating into a cigarette end, the push rod (35) having a region for influencing an electric, magnetic or electromagnetic field assigned to a sensor (32, 53), the sensor (32, 53) generating a signal, corresponding to the pushrod position, by said field being influenced, and the push rod (35) having a ferromagnetic and/or ferrimagnetic region (34) which, in a first pushrod position, penetrates concentrically into an interior of a sensor-forming coil (32), while, in a second pushrod position, said region penetrates to a lesser extent, or not at all, into the coil interior (33), said device further comprising a measuring arrangement which is electrically connected to the coil (32) and emits a signal as a function of said depth, representing the push-rod position, to which said region (34) penetrates into the coil (32), wherein the ferromagnetic and/or ferrimagnetic region (34) acts as a damping element of an oscillating circuit formed by the coil (32).

5. The device according to claim 4, wherein the damping action causes oscillation in the oscillating circuit to cease.

6. The device according to claim 4, further comprising a number of push rods (35) and sensors (32, 53) which corresponds to the number of cigarettes (12) within a cigarette formation (16), wherein said push rods and sensors are arranged such that each push rod (35) can penetrate into a cigarette of the formation (16), and the sensors (32, 53) emit a number, corresponding to said number, of signals which can be evaluated individually.

7. The device according to claim 4, further comprising an evaluation unit for evaluating the signal or the signals and for generating an alarm or control signal, in event of a fault, in order to reduce the rotational speed of the packaging and/or production machine, or in order to stop said machine.

8. The device according to claim 4, wherein said device is accommodated in a housing (19) which is displaceable in the direction of a longitudinal axis of the cigarettes and is connected mechanically to an adjustment arrangement for the purpose of advancing the push rods up to the cigarettes (12) in order to carry out a checking operation.

* * * * *